US005207096A

United States Patent [19]

Castel et al.

[11] Patent Number: 5,207,096

[45] Date of Patent: May 4, 1993

[54] ADVANCED METHOD AND DEVICE FOR IMPROVING THE PRODUCTION LOGS OF AN ACTIVATED NONFLOWING WELL

[75] Inventors: Yvon Castel, Croissy S/Seine; Jacques Lessi, Maule, both of France

[73] Assignee: Institut Francais du Petrole, Rueil-Malmaison, France

[21] Appl. No.: 713,317

[22] Filed: Jun. 11, 1991

[30] Foreign Application Priority Data

Jun. 11, 1990 [FR] France ..... 90 07312

[51] Int. Cl.[5] ..... E21B 47/00; E21B 49/08

[52] U.S. Cl. ..... 73/155; 166/250; 73/151

[58] Field of Search ..... 73/151, 152, 153, 155; 166/250

[56] References Cited

U.S. PATENT DOCUMENTS

| | | | |
|---|---|---|---|
| 2,085,972 | 7/1937 | Halliburton | 73/151 |
| 2,376,878 | 5/1945 | Lehnhard, Jr. | 73/152 |
| 3,083,774 | 4/1963 | Peters et al. | 166/250 |
| 3,163,487 | 12/1964 | Buck | 73/151 |
| 3,750,766 | 8/1973 | Thompson et al. | 73/153 |
| 3,831,443 | 8/1974 | Planche | 73/152 |
| 4,392,376 | 7/1983 | Lagus et al. | 166/250 |
| 4,442,895 | 4/1984 | Lagus et al. | 73/155 |
| 4,507,957 | 4/1985 | Montgomery et al. | 73/151 |
| 5,095,745 | 3/1992 | Desbrandes | 73/152 |

*Primary Examiner*—Robert Raevis
*Assistant Examiner*—George Dombroske
*Attorney, Agent, or Firm*—Antonelli, Terry, Stout & Kraus

[57] ABSTRACT

The method involves introducing a pumping and measuring set into a production well fitted with a pipe or liner perforated in a part extending through a producing zone. This set is fastened to the end of a flow string and comprises an activation pump and at least one set for measuring the produced effluents. The improvement essentially consists in using secondary pumping means such as a positive-displacement type pump, for example, in order to suppress the pressure drop undergone by the effluents during passage through the measuring zone, which distorts the measured values and causes parasitic flows by bypassing between the liner and the wall of well. The extent of these leak rates can be measured through a variation of the flow rate of the positive-displacement pump.

10 Claims, 3 Drawing Sheets

ADVANCED METHOD AND DEVICE FOR IMPROVING THE PRODUCTION LOGS OF AN ACTIVATED NONFLOWING WELL

BACKGROUND OF THE INVENTION

The present invention relates to improved method and device for carrying out loggings in an activated nonflowing production well which provides improved measurements.

Various embodiments of a production log method and device for a nonflowing well requiring, for its bringing in, the implementing of activation means and notably for deflected wells, are described in French patent applications FR 2,637,939 and 89/04,225. This method and this device are particularly suitable for wells intended for producing oil containing effluents. It allows determination of the most favourable well portions notably when the wells pass through heterogeneous reservoirs producing oil, but also water and gas. The equipment of a well generally comprises a casing that is kept in position through cementing. A liner perforated on at least part of its length, which is an extension of the casing, is arranged in the total zone intended for the production. This liner can be possibly cemented, the cemented annular space being fitted with passageways linking the production zone to the liner. A flow string consisting of connected successive sections and fitted with centering elements is taken down into the liner. Sealing means are arranged in the annular space between the string and the liner in order to canalize in the string the total effluents produced by the production zone. The well being nonflowing, activation means are associated with the string and taken down into the well to suck up the effluents. These activation means comprise a pump which is driven by an electric or hydraulic motor.

The logging device comprises at least one set of measuring instruments arranged at the base of the flow string in order to measure the features of part of the flows sucked up by the pump. Sealing means are arranged around the string in order to separate in two parts the pipe or liner and to limit the measurements carried out to the effluents coming from only one of these two parts. The device may also comprise two measuring sets to measure separately the features of the flows coming from the two opposite parts of the pipe and homogenization means to mix up the effluents in case of a polyphase production, in order to improve the preciseness of the measurements carried out on the flows. By lengthening or shortening the string, the logging device is displaced in order to perform measurements on the effluents flowing out of the formation in various places of the well towards the inlet of the pump.

One problem still remains which distorts the measurements on the features of the flows. It is the more or less considerable pressure drop caused by each set of measuring instruments located in the flows flowing from the activated production zone, which has the effect of acting upon the flow rates measured in each place of the producing zone. According to whether the effluents come from upstream or downstream of said set, the flowing pressures are different. Besides, because of these pressure drops, an ill-defined part of the effluents tends to bypass the measuring instruments in case of a non cemented liner, and the resulting leak rates are not measured. It is therefore advisable to be able to correct this pressure drop so that the flow rates measured all along the pipe correspond to a substantially constant flowing pressure.

SUMMARY OF THE INVENTION

The improved method according to this invention allows, by avoiding the drawbacks mentioned above, production logs to be obtained in a nonflowing well going through a subterranean zone producing effluents, this well being equipped for the production of these effluents by means of a pipe perforated in a part crossing said subterranean zone. The method comprises the use of a flow string connected with a surface installation, means for closing an annular space between the pipe and the flow string, in order to isolate in relation to one another the two parts of the pipe on either side, pumping means to activate the production of the well through said string and at least one set of measuring instruments operating on at least part of the produced effluents, arranged close to the lower end of the string.

The method also comprises the use of secondary pumping means in order to raise the pressure of the effluents before the effluents are measured in order to take into account the pressure drop undergone by the effluents while the effluents flow through each set of measuring instruments.

The method comprises, for example, the compression of only a part of the produced effluents in order to compensate for said pressure drop.

The method may also comprise the measuring of the variations of the flow rate of the effluents entering each measuring set, according to the overpressure applied by the secondary pumping means, in order to determine the variations of the amounts of effluents going from one side to the other side of the closing means between the well and said perforated pipe.

The improved device according to the invention provides production logs in a nonflowing well going through a subterranean zone producing effluents, this well being equipped for the production of these effluents by means of a pipe perforated in its part passing through said subterranean zone. The device comprises a flow string connected with a surface installation, means for closing the annular space between the pipe and the flow string, in order to isolate, in relation to each other, the two parts of the pipe on either side, pumping means for activating the production of the well through said string and means for measuring at least part of the produced effluents, arranged close to the lower end of the string. It also comprises secondary pumping means with an adjustable flow rate or pressure gain in order to compress at least part of the produced effluents before the effluents are measured, and pressure pick-ups arranged at the inlet of said secondary pumping means and at the outlet of the measuring means.

The secondary pumping means comprise for example, a pump driven by a synchronous motor supplied by an alternating-current generator arranged at the surface, by means of an electric cable.

The secondary pumping means comprise, for example, a positive-displacement pump whose output varies in a well-known way according to its engine speed, and a driving motor whose rotating speed can be adjusted with precision.

According to one embodiment of the invention, the measuring means comprise only one set of instruments to measure the features of the effluents produced on one side of said closing means, said set being associated with secondary pumping means.

According to another embodiment, the device according to the invention comprises two sets of measuring instruments to measure separately the features of the effluents respectively produced in the two parts of the well on either side of the closing means, at least one of these two sets being associated with secondary pumping means.

BRIEF DESCRIPTION OF THE DRAWINGS

Other features and advantages of the method and the device according to the invention will be clear from the following description procedures, given by way of non limitative examples, with reference to the accompanying drawings in which.

DESCRIPTION OF THE PREFERRED EMBODIMENTS

Figure 1:
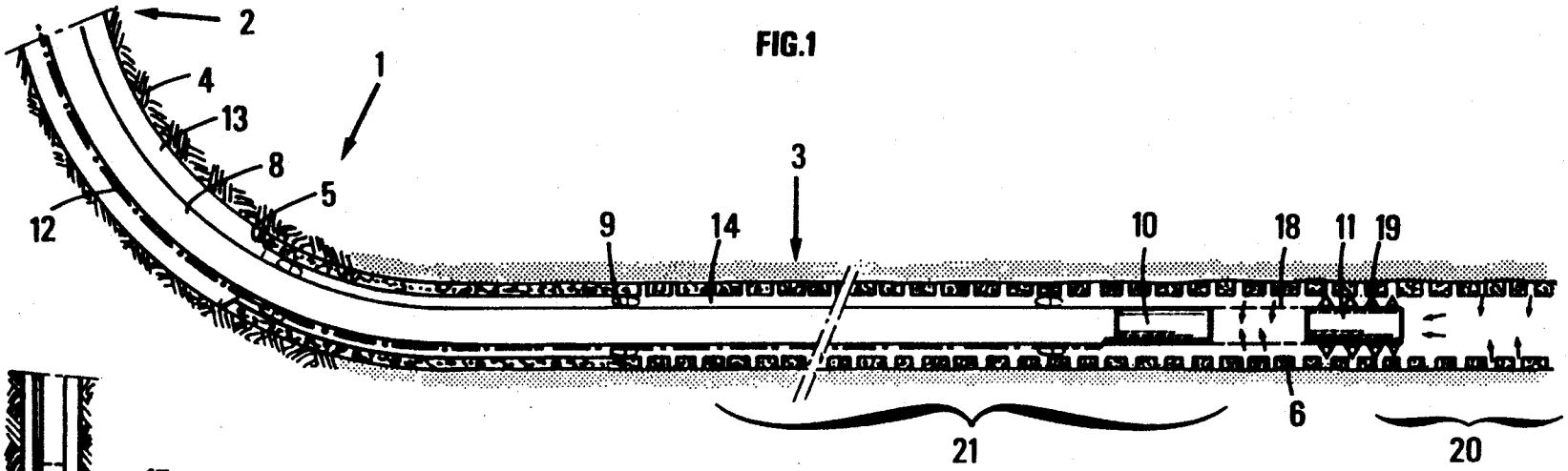
FIG. 1 shows an activation and measuring set taken down into a production well fitted with a cemented casing.
Figure 2:
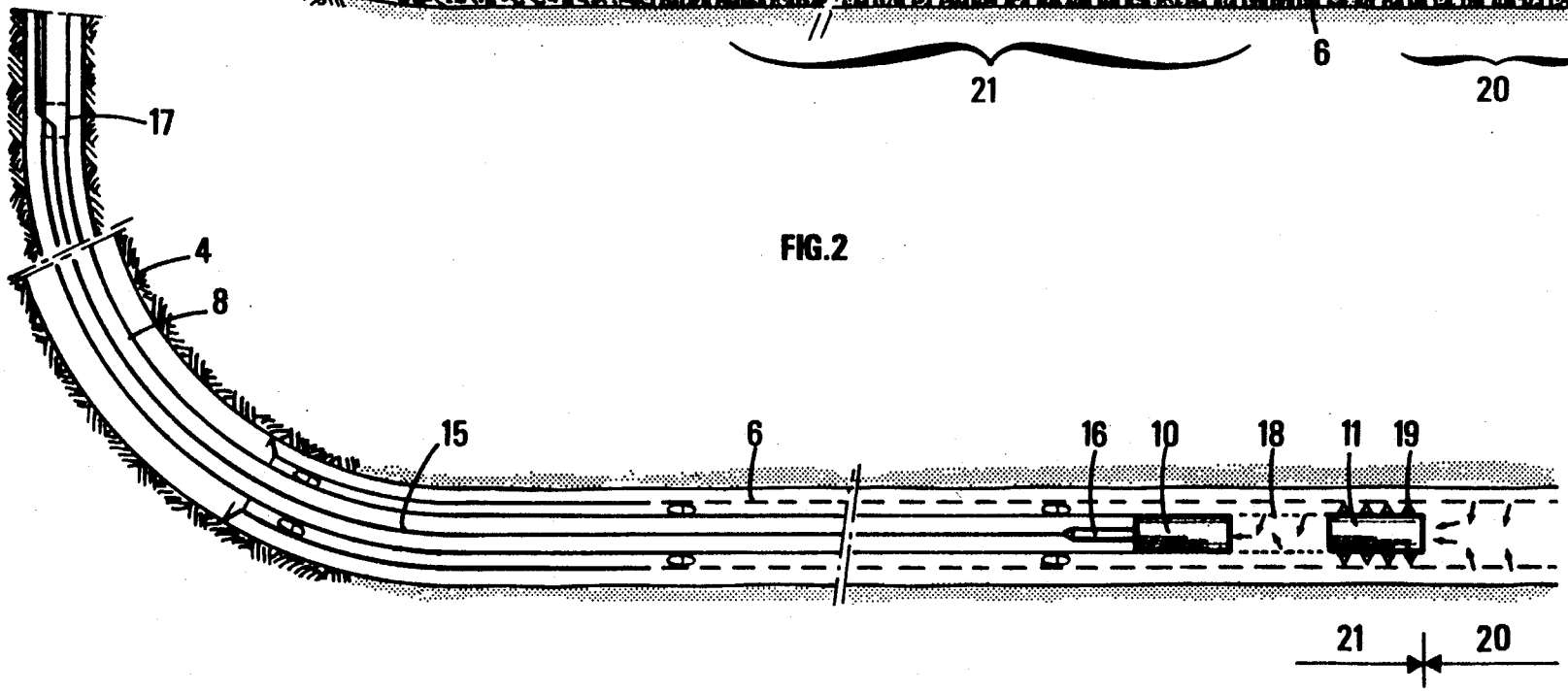
FIG. 2 shows an analogous set taken down into a well equipped with a non cemented casing.

In the production well 1 diagrammatically shown in FIG. 1 or FIG. 2, fluid flow features are to be measured in connection with the formation along the producing part of the well, and these measurements should provide an account of the variations of certain features between different spots of the production zone that is crossed by the well. Well 1 comprises a substantially vertical part 2 and a part 3, substantially horizontal or inclined in relation to the vertical, in which the oil production is carried out under normal operating conditions. In its non producing part, the well is fitted with a casing 4 ending in a shoe 5.

A pipe or liner 6 perforated on at least part of its length is arranged in this production zone. Pipe 6 may be cemented in the well (FIG. 1) or not be cemented (FIG. 2), as the case may be. The flows of fluid coming from the surrounding geologic formation take place during the activation through the perforations of the pipe and/or of the annular space between it and the well.

A string 8 preferably equipped with protectors or centralizers 9 in the deflected and horizontal part of the well is taken down into the well. Means for activating the production, such as a pump 10 and a set of instruments 11 to perform measurements on the flows of fluid outside the formation, such as the flow rate in relation to the curvilinear abscissa along the perforated pipe or the nature of the effluents oil, gas or water, etc, are arranged in this string.

Pump 10 is activated (FIG. 1) by an electric motor supplied by a multiline cable 12 passing through the annular zone 13 located between the string 8 and the casing 4, as well as through the annular zone 14 between the string 8 and the pipe 6. Multiline cable 12 is unwound from a cable drum at the surface (not shown) as the parts that constitute the string 8 are assembled and therefore as the pump 10 is taken down into the well.

The pump may also be supplied with power by a multiline cable 15 (FIG. 2) located within the string 8 and connected to the motor by a bottomhole connector 16 of the delayed connection type such as it is described in French patent 2,544,013. This cable 15 enters the string 8 through a side-entry sub 17.

The wall of the tubular string 8 is solid until the wall reaches the location of pump 10. Here the wall is provided with ports 18 in the space left between the pump and the set of instruments 11. Sealing means 19 of the cup type are, for example, arranged around the string 8 in order to separate from one another the upstream flow coming from part 20 of the formation which is furthest from the surface and the downstream flow coming from the opposite part 21 of the formation.

The upstream flow passes through the set of instruments 11 and, with the downstream flow entering through ports 18, it is collected by pump 10 and discharged towards the surface installation. By adding or removing a certain number of elements from string 8, the set of instruments 11 is displaced to a new location in the well and a series of local measurings can be performed, as described in the French patent applications cited above.

Figure 3:
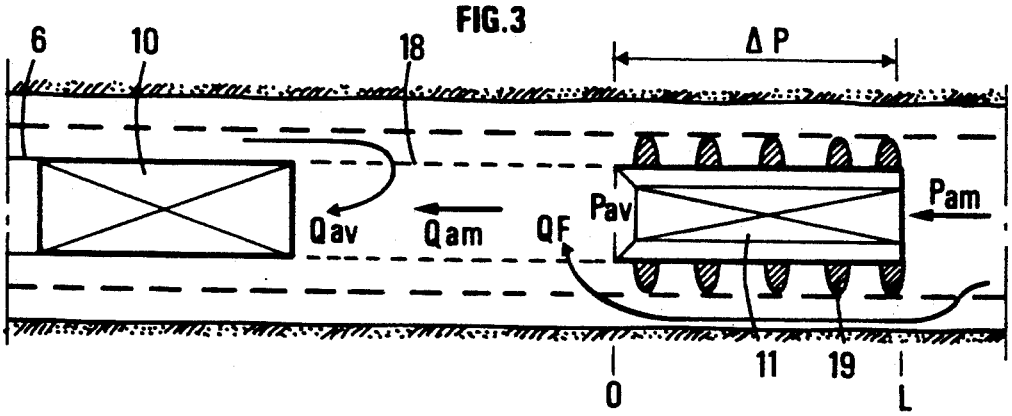
FIG. 3 shows the activation and measuring set without a secondary pumping means.

One drawback of this type of installation is the pressure drop $\Delta p$ undergone by the effluents as the effluents flow through the set of instruments 11 (FIG. 3).

Figure 4:
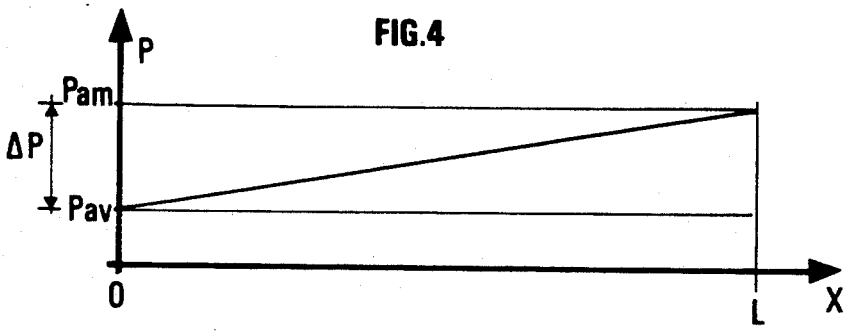
FIG. 4 shows a diagram of the pressures between the inlet and the outlet of the measuring set shown in FIG. 3.
Figure 5:
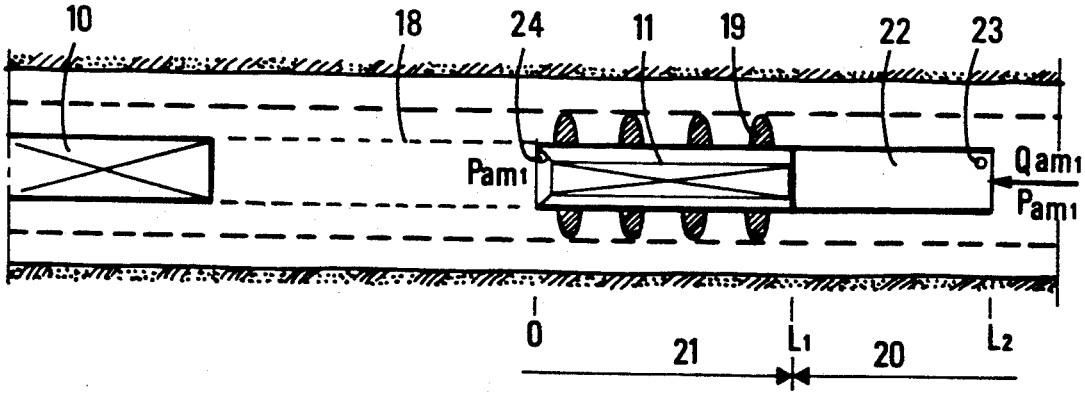
FIG. 5 shows the activation and measuring set combined with secondary pumping means.

At the outlet of the set of instruments 11 taken as a reference ($x=0$), the pressure Pav is lower than the pressure Pam at the inlet of the latter at the abscissa $x=L$ (FIG. 4). When pipe 6 is not cemented in the well (FIG. 2), part of the flow coming from the upstream zone 20 tends, because of this pressure drop which may be considerable, to bypass this set of instruments 11 and directly enter the downstream zone by flowing through ports 18. The measurements performed with the set of instruments 11 are therefore not very representative of the real flow rate coming from the upstream zone 20.

The method according to the invention allows to correct the anomalies resulting from this uncontrolled leak rate. It essentially consists in raising the pressure of the upstream effluents entering measuring set 11 enough to compensate for the pressure drop the effluents undergo while flowing through the set. To that effect, a pump 22 driven by variable-speed motor means and controlled from the surface installation is fastened to the end part of the string. It may be, for example, a two-phase or a three-phase electric motor supplied from the surface installation by means of a line included in cable 12 or 15 and connected to an alternating-current generator with a variable frequency (not shown). While changing the frequency of the current, it is possible to modify the rotating speed of pump 22 and thereby to increase or decrease its outlet pressure on demand. Pressure pick-ups 23, 24 are respectively arranged close to the inlet of pump 22 and close to the outlet of the set of measuring instruments 11.

Figure 6:
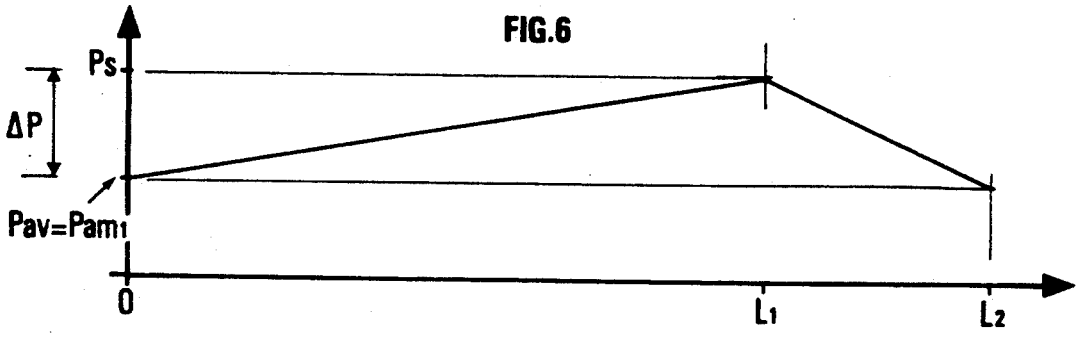
FIG. 6 shows an example of a pressure diagram modified by the presence of the secondary pumping means in case of a total compensation for the pressure drop resulting from the passing of the effluents through the set of measuring instruments.

The method according to the invention therefore essentially consists in adjusting the rotating speed of the pump so that the upstream effluents at the pressure Pam1 (abscissa L2) are brought (FIG. 6) up to a pressure PS1=Pam1+Δp before these effluents flow through the measuring instruments.

Because of the pressure drop Δp inherent in the measuring instruments, the pressure of the upstream effluents equals pressure Pam1 towards the inlet of pump 10.

A positive-displacement pump 22 driven by a motor with a variable rotating speed and precisely adjustable on a wide variation range (of the direct-current motor type) is preferably used, and the rotating speed of this pump gives the value of the flow rate of the effluents flowing through it. The flow rate Qam1 entering the positive-displacement pump at abscissa L2 is measured in this case.

Using a pump 22 of this type makes it possible to carry out measurements of leak rates when the effluents bypass the sets of measuring instruments by flowing between perforated pipe 6 and the wall of the well.

Figure 7:
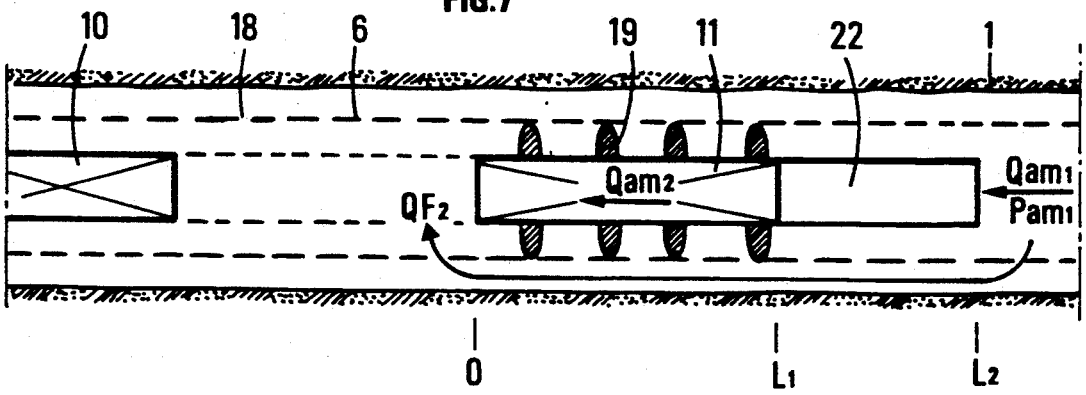
FIG. 7 and 8, respectively, correspond to FIG. 5 and 6 in case of a pressure drop under compensation.
Figure 8:
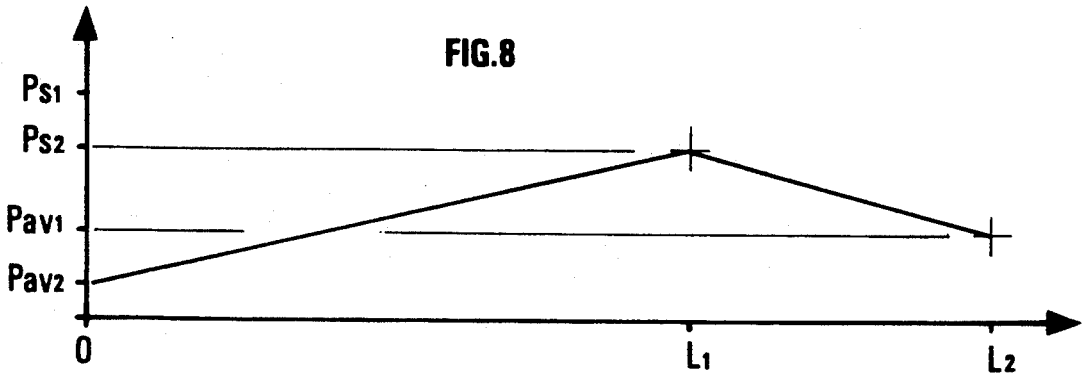

If the overpressure imposed by the positive-displacement pump 22 is decreased, the new pressure at its outlet being PS2<PS1, by modifying the adjustment of the main pump 10 in order to maintain a constant pressure Pam1, the pressure drop Δp is compensated only partly and part of the effluents escape towards ports 18 (FIG. 7, 8) and the inlet of lift pump 10 by flowing through the small space between pipe 6 and the well. Leak rate QF2 is determined by comparing the new flow rate Qam2 of the effluents flowing through positive-displacement pump 22 with the previous one Qam1:

$$QF2=Qam1-Qam2$$

Figure 9:
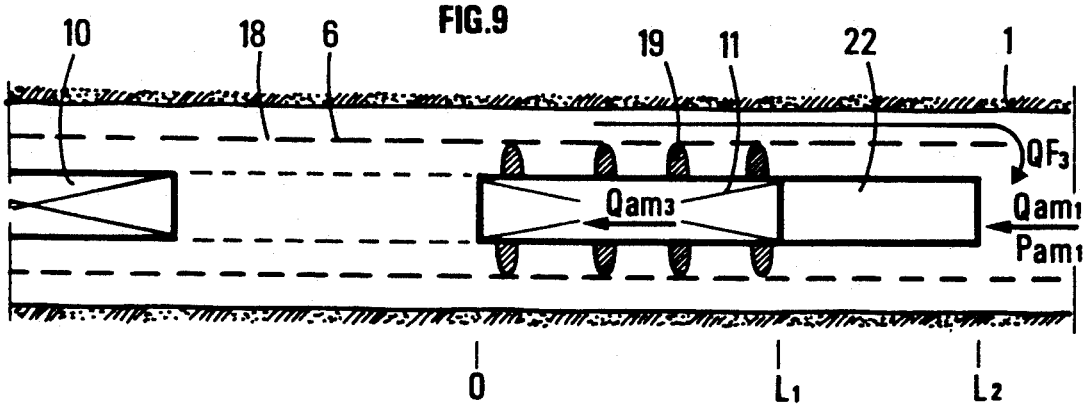
FIG. 9 and 10, respectively, correspond to FIG. 5 and 6 in case of a pressure drop overcompensation.
Figure 10:
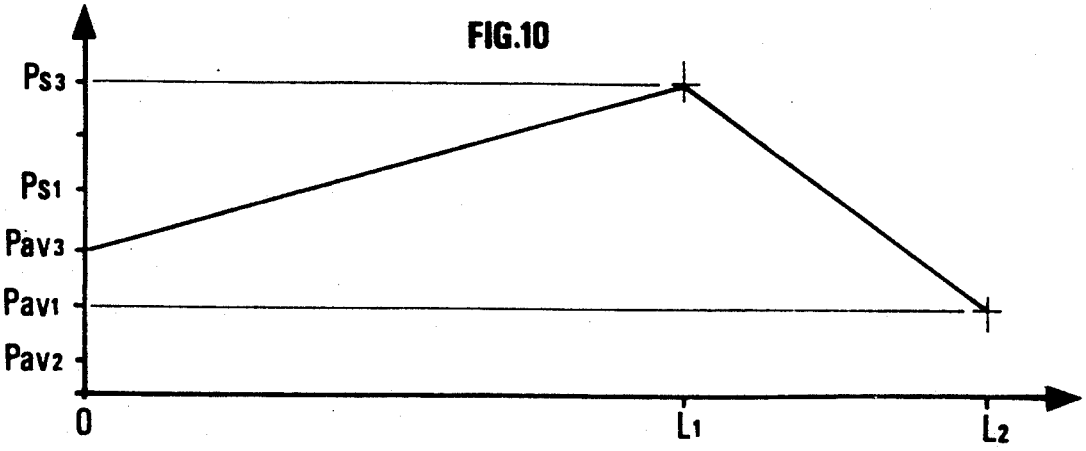

If the overpressure imposed by positive-displacement pump 22 is increased, with an outlet pressure of P3>P1, and also if the adjustment of the main pump 10 is modified in order to maintain a constant pressure Pam1, part of the effluents coming from downstream (FIG. 9, 10) will bypass the measuring set 11 by flowing between perforated pipe 6 and well 1 and also enter positive-displacement pump 22. In this case, the leak rate QF3 can also be determined by comparing the new flow rate Qam3 and flow rate Qam1:

$$QF3=Qam3-Qam1$$

The variation of the rotating speed of pump 22 therefore enables determination of the extent of the leak rates as well as their direction of flow.

The embodiment that is heretofore described only relates to the measurements performed on the upstream effluents after a compression compensating for the pressure drop. It is within the scope of the invention, as it is described in the French patent applications cited above, to measure also the downstream effluents with a second set of instruments. In this case, a previous compression of the effluents coming from the downstream zone is carried out in the same way in another positive-displacement pump of the same type as pump 22, in order to compensate for the pressure drop undergone while flowing through the second set of measuring instruments.

It is also within the scope of the invention to replace the asynchronous electric motor driving positive-displacement pump 22 by a hydraulic motor, a direct-current motor with or without brushes, etc.

We claim:

1. A improved method for carrying out production logs in a nonflowing well crossing a subterranean zone producing effluents, this well being equipped for the production of these effluents by means of a pipe perforated in its part going through said subterranean zone, the method comprising the use of a flow string connected to a surface installation, means for closing the annular space between the pipe and the flow string, in order to isolate from one another the two parts of the pipe on either side, pumping means for activating the production of the well through said string and at least one set of measuring instruments operating on at least part of the produced effluents, arranged close to the lower end, the method also comprising the use of secondary pumping means to increase the pressure of the effluents before they are measured in order to take into account the pressure drop undergone by the effluents while they flow through each set of measuring instruments.

2. A method as claimed in claim 1 comprising the compression of part of the produced effluents in order to substantially compensate for said pressure drop.

3. A method as claimed in any one of claims 1 or 2 also comprising measuring the variations of the flow rate of the effluents entering each measuring set, according to the overpressure applied by the secondary pumping means, in order to determine the variations of the amounts of effluents going from one side to the other side of said closing means between the well and said perforated pipe and their direction of flow.

4. A improved device for carrying out production logs in a nonflowing well crossing a subterranean zone producing effluents, this well being equipped for the production of these effluents by means of a pipe perforated in its part going through said subterranean zone, the device comprising a flow string connected to a surface installation, means for closing the annular space between the pipe and the flow string, in order to isolate from one another the two parts of the pipe on either side, pumping means to activate the production of the well through said string and means for measuring at least part of the produced effluents, arranged close to the lower end of the string, said device also comprising secondary pumping means with an adjustable flow rate or pressure gain in order to compress at least part of the effluents produced before they are measured, and pressure pick-ups arranged at the inlet of said secondary pumping means and at the outlet of the measuring means.

5. A improved device as claimed in claim 4 wherein the pumping means comprise a positive-displacement pump driven by an adjustable-speed motor whose flow rate varies in a well-known way according to its engine speed and a driving motor whose rotating speed is adjustable with precision.

6. A improved device as claimed in claim 4 or 5 wherein the secondary pumping means comprise a pump driven by a motor supplied by an adjustable-current generator arranged at the surface, by means of an electric cable.

7. A improved device as claimed in claim 4 or 5 wherein the secondary pumping means comprise a pump driven by a hydraulic motor.

8. A improved device as claimed in claim 4 or 5 wherein the secondary pumping means comprise a pump driven by a direct-current motor.

9. A improved device as claimed in claim 4 wherein the measuring means comprise only one measuring set for measuring the features of the effluents produced on one side of said closing means, said set of instruments being associated with secondary pumping means.

10. A improved device as claimed in claim 4 wherein the measuring means comprise two measuring sets for measuring the features of the effluents respectively produced in the two parts of the well on either side of the closing means, at least one of these sets being associated with secondary pumping means.

* * * * *